United States Patent [19]

Foerst

[11] 4,253,373

[45] Mar. 3, 1981

[54] TUNING DEVICE FOR MUSICAL INSTRUMENTS

[75] Inventor: Reiner Foerst, Gummersbach, Fed. Rep. of Germany

[73] Assignee: Dr.-Ing. Reiner Foerst GmbH, Gummersbach, Fed. Rep. of Germany

[21] Appl. No.: 958,248

[22] Filed: Nov. 6, 1978

[30] Foreign Application Priority Data

Nov. 9, 1977 [DE] Fed. Rep. of Germany ..... 2750121

[51] Int. Cl.[3] ..... G10G 7/02

[52] U.S. Cl. ..... 84/454; 84/DIG. 18; 324/79 D

[58] Field of Search ..... 84/454, DIG. 18; 324/78 R, 78 D, 78 F, 78 Q, 79 D

[56] References Cited

U.S. PATENT DOCUMENTS

| | | | |
|---|---|---|---|
| 4,122,751 | 10/1978 | Calvin | 84/454 |
| 4,205,584 | 6/1980 | Foerst | 84/454 |

*Primary Examiner*—L. T. Hix
*Assistant Examiner*—S. D. Schreyer
*Attorney, Agent, or Firm*—Becker & Becker, Inc.

[57] ABSTRACT

A device for the measurement of the number of cycles or half-cycles of a tone by counting the cycles during a reference time which is proportional to the cycle time of the tone to be measured, comprising a store for the cycle times, a comparator, a subtraction device in which a constant value is subtracted from the counted number of tone cycles, decoders, displaying devices for the oscillation error and the polarity sign, a retriggerable mono-flop for the oscillation existence signal, a flip-flop for a wait signal, a mono-flop for a read signal and logic elements for enabling the oscillation counter and the reference pulse counter.

4 Claims, 1 Drawing Figure

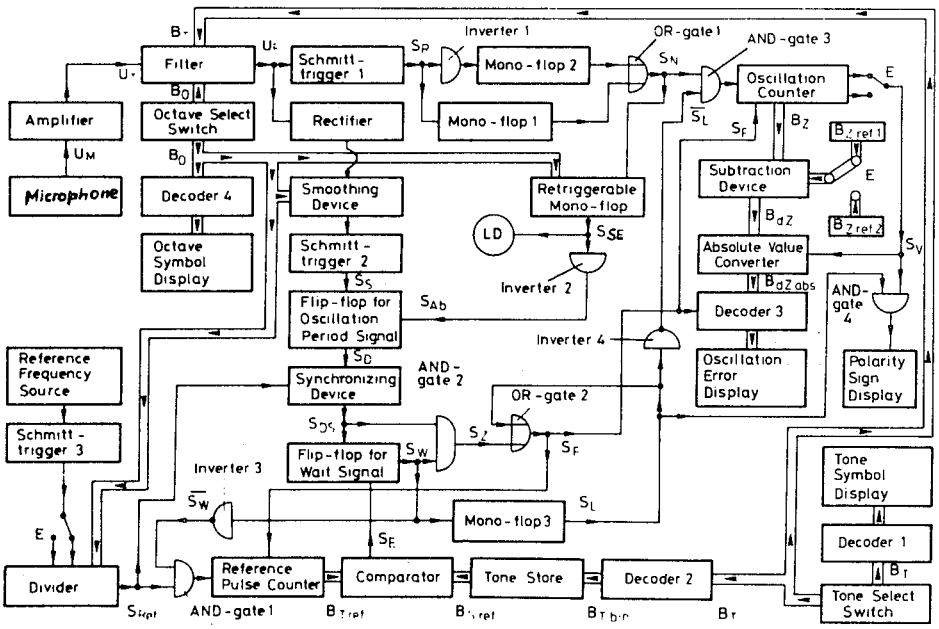

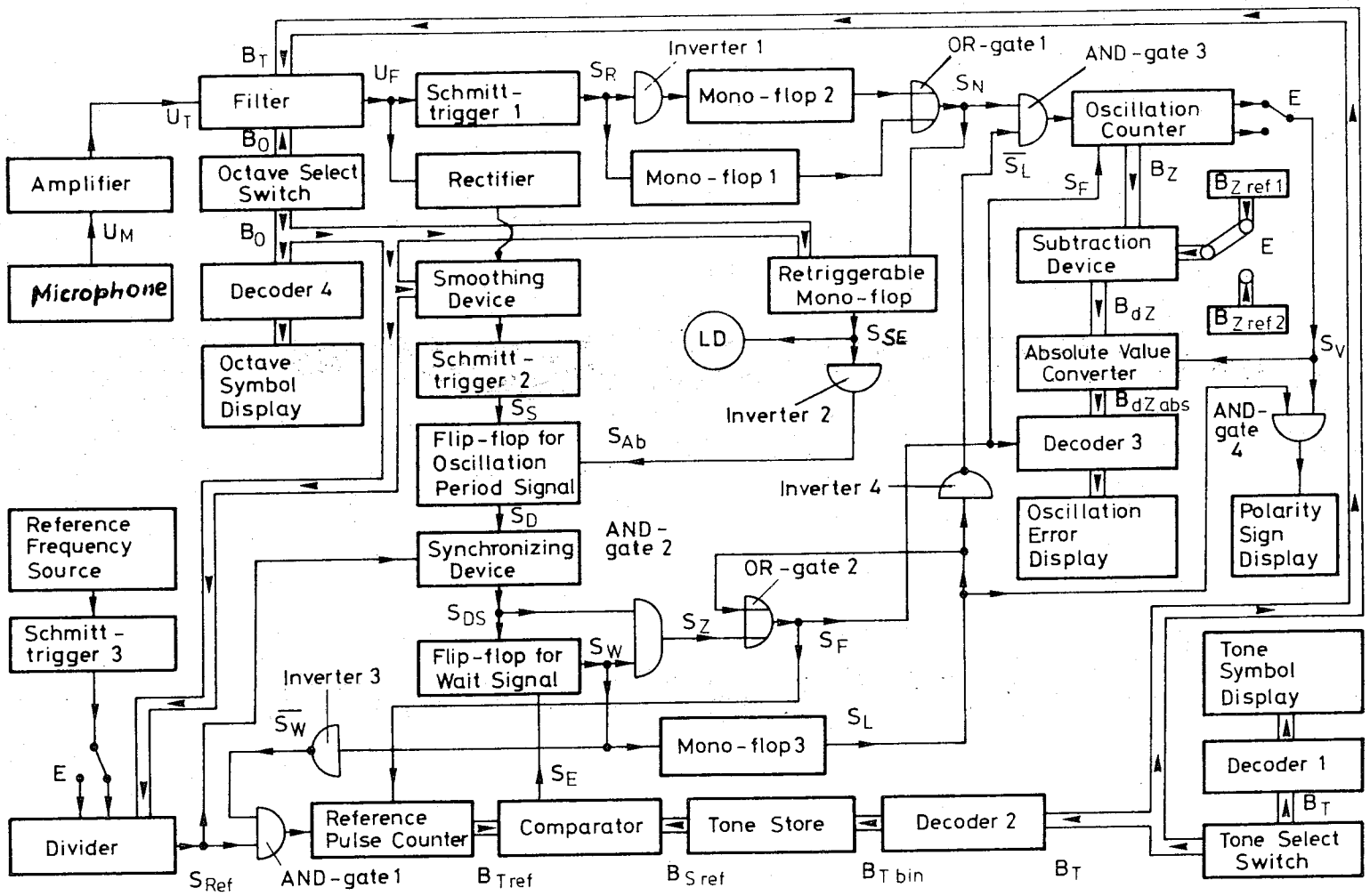
Amplifier
Microphone
Filter
Octave Select Switch
Decoder 4
Octave Symbol Display
Schmitt-trigger 1
Rectifier
Smoothing Device
Schmitt-trigger 2
Flip-flop for Oscillation Period Signal
Synchronizing Device
Flip-flop for Wait Signal
Reference Frequency Source
Schmitt-trigger 3
Divider
Reference Pulse Counter
Comparator
Tone Store
Decoder 2
Tone Select Switch
Decoder 1
Tone Symbol Display
Polarity Sign Display
AND-gate 4
Oscillation Counter
Subtraction Device
Absolute Value Converter
Decoder 3
Oscillation Error Display
Mono-flop 2
Mono-flop 1
Retriggerable Mono-flop
Mono-flop3
LD
Inverter 1
Inverter 2
Inverter 3
Inverter 4
OR-gate 1
OR-gate 2
AND-gate 1
AND-gate 2
AND-gate 3
E

TUNING DEVICE FOR MUSICAL INSTRUMENTS

The present invention relates to a device for the measurement of the number of cycles or half cycles of a tone during a preset reference time period.

Tuning devices of the above mentioned kind or similar devices are already known.

In the U.S. Pat. No. 3,144,802 "TUNING APPARATUS", a device is described by which the tone oscillation is converted into a digital signal and supplied to a counter and a display device via an AND-gate which is open during a preset constant time period. Thereby it is assumed that the tone oscillation is sufficiently long, so that the AND-gate can be opened and closed periodically during the oscillation. During the closed period the counter is reset.

One disadvantage of this performance is that fastly decaying tones can be measured only with difficulty as the start of the counting period is not coordinated with the increasing amplitude of the tone. Another disadvantage is that the absolute value of the tone frequency is displayed. Thus, the tuner needs a table from which he reads the reference values of every individual tone.

In the U.S. Pat. No. 3,948,140 "PORTABLE DEVICE FOR GENERATING AND TUNING A WHOLE TONE SCALE", a means is described which comprises a reference oscillator. The tone oscillation is converted into a digital signal and logically compared to the reference signal. With the instrument being out of tune a phase movement is displayed. One disadvantage of this device is that the frequency error is not displayed quantitatively as the oscillations are not counted. Another disadvantage is that very high tones cannot be measured as the display time is not sufficiently long for the observer.

In the British Pat. No. 1,213,794 "TUNING OF MUSICAL INSTRUMENTS", a method and a device are described with which in principle not the frequency but the cycle time of the tone oscillation is measured. During a preset number of cycles of the tone oscillation which is counted by a counter an AND-gate is opened. Pulses of a high-frequency reference voltage source pass this AND-gate and are counted behind the gate in a second counter. This counter is a pre-select counter the pre-select number of which is selected by a tone select switch and supplied from a store (diode matrix). By this method it is achieved that the error, which is the deviation from the in-tune value, is displayed. It is assumed that the tone oscillation is kept in resonance by an electromagnetic stimulating device, long enough that the AND-gate can be opened and closed periodically during the oscillation. One disadvantage of this performance is the necessity for the stimulating device. Another disadvantage is that the displayed error is not a quantitatively usable measure for the relative error. Firstly this renders the tuning process more difficult, and secondly it restricts the tuning to standard pitch. Another disadvantage is that by inevitable phase errors which will be produced in the harmonic filters in case of the fundamental wave of the tone oscillation being small compared to its maximum amplitude the measured cycle time and consequently the displayed number is not accurate especially for low tones.

Another tuning device for musical instruments of copending application Ser. No. 896,762-Foerst filed Apr. 17, 1978 (Monday), now U.S. Pat. No. 4,205,585-Foerst dated June 3, 1980 is known by which the tone oscillation is converted into a digital signal and supplied to an AND-gate and a counter. The AND-gate is opened when the amplitude of the tone oscillation exceeds a preset threshold and closes after a preset reference time. The display vanishes when the amplitude of the tone oscillation falls short of another preset threshold. One disadvantage of this performance is that the user needs a table for the correct oscillation figures. Another disadvantage is that the frequency range of the tones to be measured is limited at low frequencies by the accuracy of the display and at high frequencies and at string instruments by the time constant of the damping of the tone oscillation. Other disadvantages are that the display vanishes fastly at short tones and that long tones have to be dampend before the display vanishes. Therefore, that performance is suitable mainly for guitars.

Therefore, it is an object of the present invention to exhibit a device which meets requirements as follows. Fast fading tonew should also be measurable. The counting process should start after the increasing of the tone amplitude. The accuracy should be equal and as large as possible for all tones. The counting period should be as short as possible. The reading period should be constant. A table for comparison should not be necessary. The error relative to the frequency of the tone to be measured should be displayed together with the polarity sign.

The basic idea of the invention is that the measuring period within which the tone cycles are counted is preset proportionally to the period of the fundamental of the tone to be measured. This presetting is performed in steps by the same switches by which the filters for filtering out the fundamental or an harmonic of the order $2^n$ of the tone to be measured are switched in. Using this method, with correct tuning of the instrument, the measuring device supplies a frequency value which is equal for all tones. This number may be chosen following the laws of economical circuit design or of the calibration of the display. The invention provides that the chosen constant reference number is subtracted from the digital measuring value of the oscillation or half oscillation frequency and that only the error against standard pitch together with the polarity sign is displayed.

In order to firstly guarantee a sufficiently long display duration at very short tones and secondly not to hold up the tuning process by the inherent damping of the oscillation of a string at long tones, the invention provides a constant reading duration after the counting process in a way that a new counting process can be started only when the display has vanished. In case that the oscillation fades down to zero during the reference period, it is provided that the display vanishes instantly.

The invention is illustrated by way of a block diagram in the accompanying drawing.

Referring now to the drawing, first the known features may be described. The output voltage $U_M$ of a microphone or a musical instrument with electrical tone signal is amplified in an amplifier to the tone frequency voltage $U_T$. The tone frequency voltage $U_T$ affected with harmonics is cleaned of its harmonics in a filter in a way that guarantees only one zero transit per half wave. The filtered tone frequency voltage $U_F$ is converted in a Schmitt-trigger 1 into a digital signal $S_R$. The length of this rectangle is reduced in a mono-flop 1 to a value which is shorter than the half cycle of the maximum frequency to be measured. A second mono-flop 2 generates the short pulse for the other zero transit of the tone frequency voltage using the rectangular signal inverted in an inverter 1. The short pulses $S_{K1}$ and $S_{K2}$ are added in an OR-gate 1. The sum is called zero transit signal $S_N$. The filtered tone frequency voltage $U_F$ is also rectified in a rectifier, smoothed in a smoothing device, and converted in a Schmitt-trigger 2 into a digital starting signal $S_S$. The starting signal $S_S$ sets a flip-flot determining the oscillation period signal $S_D$. A reference frequency voltage source generates a voltage which is converted by a Schmitt-trigger 3 and a divider into the digital reference pulse signal $S_{Ref}$. The signal $S_{Ref}$ is supplied to a synchronizing device to which also the oscillation period signal $S_D$ from th flip-flop is supplied. The synchronizing device supplies the synchronized oscillation period signal $S_{DS}$.

The new features are described as follows. In the example of the block diagram an electronic switch is provided for the filter selection. The switch positions of the octave select switch and the 12-pole tone select switch create the binary words $B_o$ and $B_T$. The binary word $B_o$ selects the octave, the binary word $B_T$ the relative pitch of the tone to be tuned in the filter. The octave symbol as well as the tone symbol are displayed after conversion in suitable code-converters 4 and 1.

In the block diagram, a retriggerable mono-flop is provided for the generation of the oscillation existence signal $S_{SE}$ which meets the requirement to create a digital long-time signal using the periodical zero transit signal $S_N$. According to the invention the time delay is made dependent on the position of the octave select switch. This long-time signal inverted by the inverter 2 is called decay signal $S_{Ab}$. It resets the flip-flop for the oscillation period signal $S_D$.

In the example of the block diagram a two-step accuracy select switch E is provided. This one changes the dual divider ratio in the divider being connected to the output of the reference voltage source. The dual divider ratio is adjusted additionally by an electronic switch in conformity with the position of the octave select switch in a way that the frequency of the reference signal $S_{Ref}$ is doubled per octave.

The reference signal $S_{Ref}$ is supplied via an AND-gate 1 to the reference pulse counter as long as the wait signal $\overline{S_W}$ inverted in an inverter 3 is positive. The intermediate outputs of the reference pulse counter supply the reference time byte $B_{tRef}$ to a comparator. The reference pulse counter is enabled by the enable signal $S_F$.

The second input of the comparator is the store reference time byte $b_{SRef}$ which is supplied by a store. For the addressing of this store the binary tone byte $B_{TBin}$ is used which is coded in a decoder 2. The comparator supplies the counting period end signal $S_E$ when the two types $B_{tRef}$ and $B_{SRef}$ are equal. The signal $S_E$ sets the flip-flop for the wait signal $S_W$. This flip-flop is reset by the output $S_{DS}$ (synchronized oscillation period signal) of the synchronizing device.

The two signals $S_W$ and $S_{DS}$ are combined to the counting time signal $S_Z$ via an AND-gate 2. The wait signal $S_W$ is converted into the read signal $S_L$ by a mono-flop 3. The read signal $S_L$ and the counting time signal $S_Z$ are combined to the enable signal $S_F$ via an OR-gate 2. Additionally, the read signal $S_L$ is supplied via an inverter 4 together with the zero transit signal $S_N$ to the AND-gate 3.

The output of this AND-gate 3 is supplied to the input of the oscillation counter. The intermediate outputs of this counter are the counting byte $B_Z$. From this value the constant value $B_{ZRef}$ is subtracted in a subtraction device. The constant value $B_{ZRef}$ is dependent on the position of the accuracy select switch which works preferably in dual steps.

The oscillation difference $B_{dZ}$ is supplied to an absolute value converter, which passes it to its output positively or negatively dependent on the polarity sign. The absolute value $B_{dZabs}$ of the oscillation difference is supplied to the display device via a decoder 3. The display is enabled by the enable signal $S_F$.

The polarity signal $S_V$ is supplied by the highest order bit of the oscillation counter depending on the selection E of the accuracy. It is suppled to the display device together with the read signal $S_L$ via an AND-gate 4. Additionally to the proper measuring device the invention provides a display for the oscillation existence. A photo diode LD is lightened when the oscillation existence signal $S_{SE}$ is positive.

It is, of course, to be understood that the present invention is, by no means, limited to the specific showing in the drawing, but also comprises any modifications within the scope of the appended claims.

What I claim is:

1. A device for the measurement of the number of cycles or half cycles of a tone during a preset reference time including a microphone, an amplifier, a filter for the prevention of zero transits extraneous to the fundamental tone oscillation, a Schmitt-trigger for the conversion of the filtered tone frequency voltage $U_F$ into a digital oscillation signal $S_R$, two mono-flops for the conversion of the digital tone oscillation signal $S_R$ into a zero transit signal $S_N$, a flip-flop for the oscillation period signal $S_D$ which is set via a rectifier, a smoothing device, and a Schmitt-trigger by the increasing amplitude of the filtered tone frequency voltage $U_F$ and which is reset by an inverted oscillation existance signal $S_{SE}$, a synchronizing device, a reference frequency source, a reference pulse counter, and an oscillation counter to which the zero transit signal $S_N$ is supplied via an AND-gate, said device comprising in combination therewith a tone store in which the values for the tone cycle lengths $B_{Sref}$ are stored, and which is addressable from a tone select switch via a decoder, and also comprising in combination therewith a comparator supplying a counting period end signal $S_E$ when the output $B_{Tref}$ of the reference pulse counter and the stored cycle length value $B_{Sref}$ are equal, electronic swtiches for the selection of the harmonics filters which are controlled by the tone select switch and additionally by an octave select switch according to the tone to be tuned, a display means for the symbol of the selected octave which is controlled via a decoder by said octave select switch, a smoothing device for the setting of the flip-flop for the reference period signal by the increasing tone amplitude, the time constant of said smoothing device being adjustable by said octave select switch, a retriggerable mono-flop the input of which is the zero transit signal $S_N$ of the tone oscillation and the output of which is the oscillation existence signal $S_{SE}$ for the resetting of the flip-flop for the oscillation period signal $S_D$, a flip-flop supplying a wait signal $S_W$ which is set by the counting period end signal $S_E$ and reset by the output $S_{DS}$ of the synchronizing device, an AND-gate, one input of which is the inverted wait signal $S_W$, the second input of which is the reference pulse signal $S_{Ref}$ and the output of which is supplied to the reference pulse counter, and an AND-gate, one input of which is the wait signal $S_W$, the second input of which is the synchronized oscillation period signal $S_{DS}$, and the output of which supplies a counting period signal $S_Z$, a monoflop the input of which is the wait signal $S_W$ and the output of which supplies a read signal $S_L$, an AND-gate, one input of which is the inverted read signal $\overline{S_L}$, the other input of which is the zero transit signal $S_N$ and the output of which is supplied to the input of the oscillation counter and an OR-gate, one input of which is the read signal $S_L$, the other input of which is the counting period signal $S_Z$, and the output of which supplies an enable signal $S_F$ for the oscillation counter.

2. A device in combination according to claim 1 comprising a reference value store for constant references bytes $B_{Zref}$, and a subtraction device the output of which supplies the oscillation difference $B_{dZ}$ between the oscillation byte $B_Z$ and the reference byte $B_{Zref}$.

3. A device in combination according to claim 2, comprising a display means for the polarity sign the input of which is supplied from the highest order bit $S_V$ of the oscillation byte via an AND-gate, the other input of which is the read signal $S_L$.

4. A device in combination according to claim 3, comprising an absolute value converter the inputs of which are the polarity sign signal $S_V$ and the oscillation difference byte $B_{dZ}$ and the output of which is the byte for the absolute value $B_{dZabs}$ of the oscillation difference.

* * * * *